United States Patent [19]

Bricker et al.

[11] 4,314,425

[45] Feb. 9, 1982

[54] COOLANT ASSEMBLY FOR A CYLINDRICAL GRINDING MACHINE

[75] Inventors: Robert E. Bricker, Waynesboro; Paul J. Humpleby, Chambersburg, both of Pa.

[73] Assignee: Litton Industrial Products, Inc., Waynesboro, Pa.

[21] Appl. No.: 168,457

[22] Filed: Jul. 10, 1980

[51] Int. Cl.[3] ..... B24B 55/02

[52] U.S. Cl. ..... 51/267

[58] Field of Search ..... 51/267, 266, 268, 269, 51/272

[56] References Cited

U.S. PATENT DOCUMENTS 3,835,595 9/1974 Oshima et al. ..... 51/268

4,060,942 12/1977 White et al. ..... 51/268

FOREIGN PATENT DOCUMENTS 476149 11/1975 U.S.S.R. ..... 51/267

*Primary Examiner*—Roscoe V. Parker

*Attorney, Agent, or Firm*—Spencer T. Smith

[57] ABSTRACT

A cylindrical grinding machine having a base for supporting a rotatable workpiece, a wheelhead assembly mounted on the base for horizontal displacement thereon including a grinding wheel for effecting stock removal from the workpiece, a housing for rotatably supporting and guarding the grinding wheel, a selectively advanceable dressing tool for dressing the grinding wheel, a coolant assembly including a horizontal member and a vertically downwardly extending nozzle mounted for slidable movement relative to the housing as the grinding wheel is reduced in size so as to continuously maintain the downwardly extending coolant nozzle vertically above the area of the grinding wheel which grindingly engages the workpiece.

1 Claim, 2 Drawing Figures

COOLANT ASSEMBLY FOR A CYLINDRICAL GRINDING MACHINE

Figure 1:
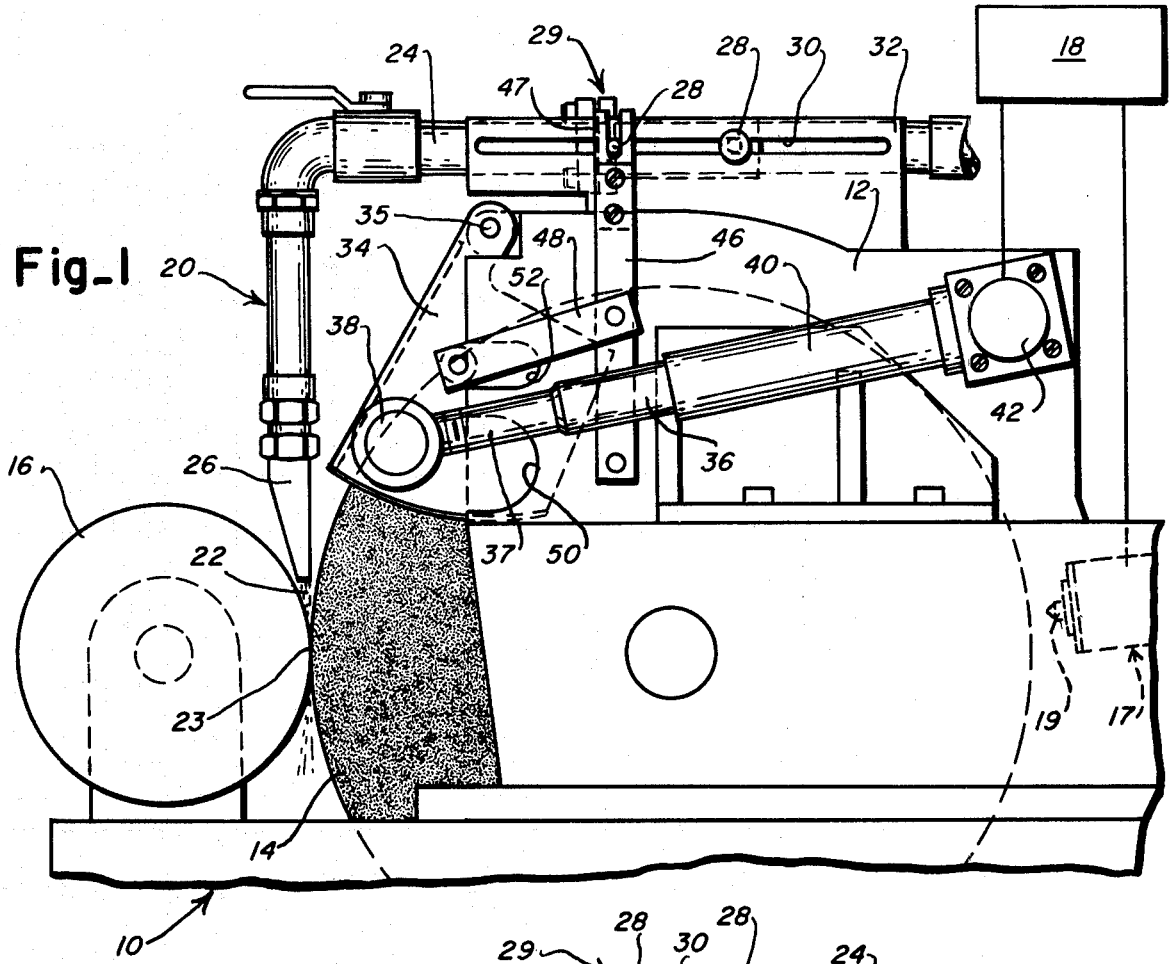

The present invention relates to cylindrical grinding machines having a coolant assembly for providing coolant during the grinding operation.

Coolant assemblies are often mounted on the base of a cylindrical grinding machine for supplying coolant to the area of engagement of the rotating grinding wheel and the workpiece being machined. In such cylindrical grinding machines, the orientation of the coolant assembly nozzle must be adjusted when a workpiece having a different size is machined. Coolant assemblies have been mounted on the wheelhead of cylindrical grinding machines by securing the coolant assembly nozzle to a pivotally mounted wheel guard hood but the nozzle does not precisely follow the area of the grinding wheel which engages the workpiece as the grinding wheel is reduced in size.

An object of this invention is to provide a cylindrical grinding machine having a coolant assembly which continuously directs coolant to the area of grinding contact of the grinding wheel regardless of the size of the grinding wheel or the size of the workpiece.

Other objects and advantages of the present invention will become apparent from the following portion of this specification and from the accompanying drawings which illustrate, in accordance with the mandate of the patent statutes, a presently preferred embodiment incorporating the principals of the invention.

Figure 2:
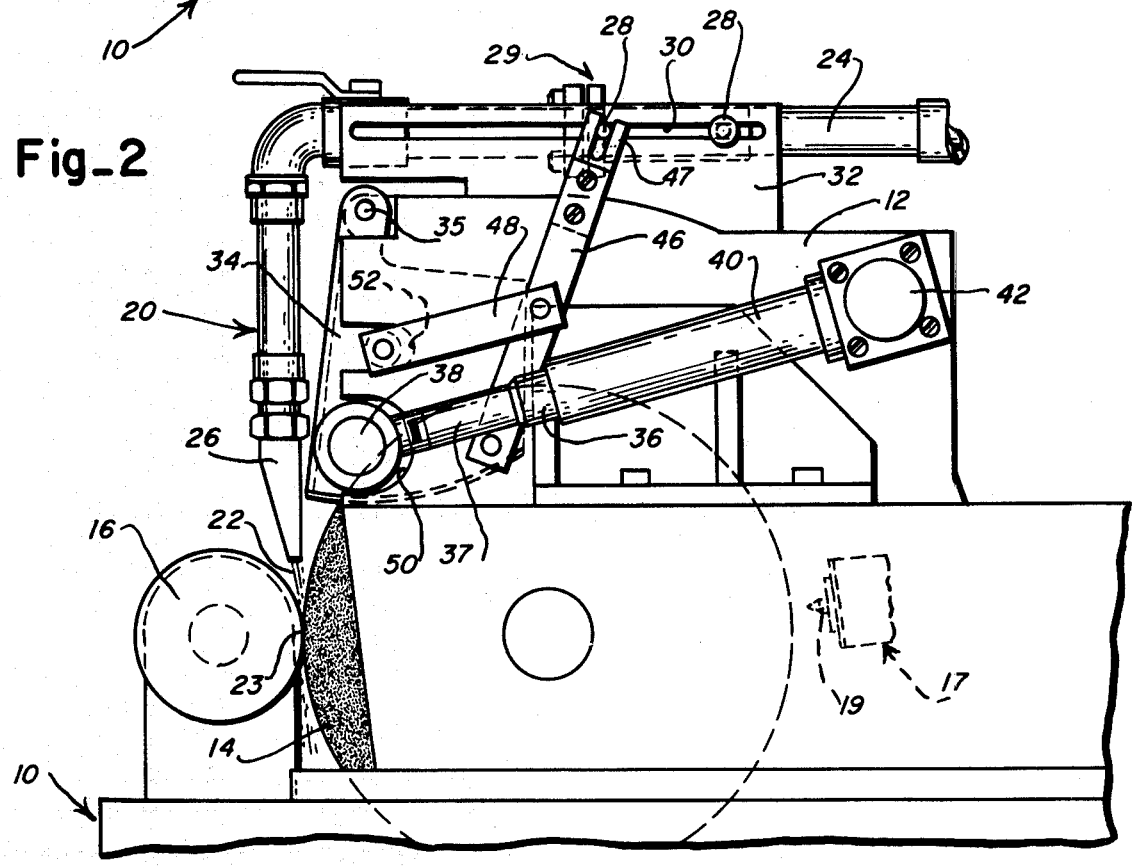

Referring to the drawings:

FIG. 1 is an elevational view of a cylindrical grinding machine made in accordance with the teachings of the present invention; and FIG. 2 is an elevational view of the cylindrical grinding machine shown in FIG. 1 grinding a smaller diametered workpiece after the size of grinding wheel has been reduced to its minimum size.

The cylindrical grinding machine includes a base 10 slidably supporting a selectively advanceable wheelhead assembly having a housing 12 supporting and guarding a rotatable grinding wheel 14 for effecting stock removal from a cylindrical workpiece 16. A grinding wheel dresser assembly 17 is provided which is controlled by a stepping control device 18 and which includes a selectively advanceable dressing tool 19 for dressing the grinding wheel 14.

A coolant assembly 20 directs substantial amounts of coolant 22 to the area 23 of the grinding wheel 14 which engages the workpiece 16 during the grinding operation. The coolant assembly 20 includes a horizontally extending pipe section 24 which merges into a vertically downwardly extending coolant nozzle 26. The coolant assembly 20 is mounted for horizontal slidable displacement on the top of the wheelhead housing 12. Axially spaced pin pairs 28 extending horizontally outwardly from a bracket 29 which is clamped about the coolant pipe 24 are received in horizontal slots 30 (only one shown) defined in coolant assembly supports 32 which extend upwardly from the housing 12 on either side of the pipe 24.

A wheel guard hood 34 is pivotally mounted to the housing 12 on pivot shaft 35 to shroud the upper front portion of the rotatable grinding wheel 14. The wheel guard hood 34 is maintained proximate to the circumference of the grinding wheel 14 by a retractable rod 36 having a threaded end 37 which engages a swivel nut assembly 38 mounted on the hood 34. The opposite end of the rod 36 is supported within a sleeve 40 and is displaced within the sleeve 40 by a stepping motor 42 which is pivotally supported on the housing 12.

As the size of the grinding wheel 14 is reduced, the numerical control device 18 sends signals to actuate the stepping motor 42 to retract the rod 36, and thereby the hood 34, a selected increment. In the preferred embodiment, the wheel guard hood 34 is maintained within 0.250 inches of the circumference of the grinding wheel 14.

A first link member 46 is pivotally mounted at its lower end to the housing 12 and has a bifurcated upper end 47 opposite thereto for operatively engaging one of the pins 28 which extends horizontally outwardly from the bracket 29. A second link member 48 is pivotally mounted at one end to the hood and pivotally mounted at the opposite end to a medial portion of the first link member 46 so that pivotal displacement of the wheel hood 34 will horizontally displace the coolant assembly 20 relative to the housing 12. In the preferred embodiment, the wheelhead housing has selectively defined cutouts 50 and 52 to allow the hood 34 to be fully retracted within the housing without interference with the pivotal connections to the rod 37 and second link 48, respectively.

As can be seen in FIGS. 1 and 2, the linkage arrangement slidably displaces the coolant assembly 20 as the grinding wheel 14 reduces in size to continuously maintain the flow of coolant 22 vertically above the area 23 of the grinding wheel which grindingly engages the workpiece 16 regardless of the size of the grinding wheel or workpiece.

What is claimed is:

1. A cylindrical grinding machine having a base for supporting a rotatable workpiece, a wheelhead assembly mounted on said base for horizontal displacement thereon including a grinding wheel for effecting stock removal from the workpiece, housing means for rotatably supporting and guarding said grinding wheel, dresser means including a selectively advanceable dressing tool for dressing the grinding wheel, coolant assembly means including a horizontal member and a vertically downwardly extending nozzle, means for mounting said coolant assembly means on said wheelhead assembly for relative horizontal displacement whereby the vertical orientation of said nozzle will be maintained, means for horizontally slidably displacing said coolant assembly means relative to said housing means as said grinding wheel is reduced in size to continuously maintain said vertically downwardly extending coolant nozzle vertically above the area of said grinding wheel which grindingly engages the workpiece including wheel hood means pivotally mounted to said housing means for shrouding the grinding wheel, means for incrementally pivotally displacing said wheel hood means to maintain said wheel hood means proximate said grinding wheel, first link means pivotally mounted at one end to said housing means and operatively connected to said coolant assembly means at the other end thereof, and second link means pivotally mounted at one end to said wheel hood means and pivotally mounted at the other end to a medial portion of said first link means.

* * * * *